US007131701B1

(12) United States Patent
Yang

(10) Patent No.: US 7,131,701 B1
(45) Date of Patent: Nov. 7, 2006

(54) INFLATABLE FURNITURE ASSEMBLY

(75) Inventor: Chou-Lian Yang, Taipei (TW)

(73) Assignee: Jesung Co., Ltd., Taichung (JP)

( * ) Notice: Subject to any disclaimer, the term of this patent is extended or adjusted under 35 U.S.C. 154(b) by 0 days.

(21) Appl. No.: 11/320,652

(22) Filed: Dec. 30, 2005

(30) Foreign Application Priority Data

Sep. 7, 2005 (TW) ..... 94215353 U

(51) Int. Cl.
*A47C 7/02* (2006.01)

(52) U.S. Cl. ..... 297/452.41; 297/440.14

(58) Field of Classification Search ..... 297/452.41, 297/DIG. 3, 440.14, 219.1; 5/655.3, 645
See application file for complete search history.

(56) References Cited

U.S. PATENT DOCUMENTS 2,150,434 A * 3/1939 Finlay ..... 297/452.41
3,572,836 A * 3/1971 Khanh ..... 297/452.41

* cited by examiner

*Primary Examiner*—Milton Nelson, Jr.
(74) *Attorney, Agent, or Firm*—Bacon & Thomas, PLLC

(57) ABSTRACT

An inflatable furniture assembly of has a plurality of inflatable cushions, inflation valves, covers, and connecting elements. The inflatable furniture assembly is formed from the plurality of inflatable cushions; each inflatable cushion has an inflation valve and can be covered by a cover to form a unit with an improved appearance. The cover comprises at least one opening corresponding to the inflation valve so that each unit can be inflated. Each unit has at least one connecting element that comprises self-adhesive tape or connecting rod so the units can be combined with the self-adhesive tape to form the inflatable furniture assembly.

4 Claims, 8 Drawing Sheets

INFLATABLE FURNITURE ASSEMBLY

BACKGROUND OF THE INVENTION

1. Field of the Invention

The present invention relates to an inflatable furniture assembly, and more particularly, to an inflatable furniture assembly that is easy to disassemble, assemble, store and transport.

2. Description of the Related Art

One of the most popular pieces of inflatable furniture is the air bed, which can be deflated for easy storage. Currently, other types of inflatable furniture exist on the market, such as inflatable sofas, but they are not very popular. This is primarily due to their appearance, which is not very attractive. Moreover, it is more expensive to manufacture sofas because they have more complicated structures.

Therefore, it is desirable to provide an inflatable furniture assembly to mitigate and/or obviate the aforementioned problems.

SUMMARY OF THE INVENTION

An objective of the present invention is to provide an inflatable furniture assembly that is easy to disassemble, assemble, store and transport.

Another objective of the present invention is to provide an inflatable furniture assembly that can easily let users to change different colors, textures of cover due to different environment, season, or mood.

Yet another objective of the present invention is to provide an inflatable furniture assembly that has reduced manufacturing costs.

Another objective of the present invention is to provide an inflatable furniture assembly, such as a sofa, that has an appearance similar to a traditional sofa.

Another main objective of the present invention is to let users to flexibly assemble different number, dimension, or assembling style of sofa due to users' need or room space.

A further objective of the present invention is to provide an inflatable furniture assembly that is different from other filled sofas so that it does not collect bacteria or dust, and is not a burden on landfills.

In order to achieve the above-mentioned objectives, the inflatable furniture assembly of the present invention comprises a plurality of inflatable cushions, inflation valves, covers, and connecting elements. The inflatable furniture assembly is formed from the plurality of inflatable cushions; each inflatable cushion has an inflation valve and can be covered by a cover to form a unit with an improved appearance. The cover comprises at least one opening corresponding to the inflation valve so that each unit can be inflated. Each unit has at least one connecting element, such as connecting rods or self-adhesive tape so the units can be combined together to form the inflatable furniture assembly.

Other objects, advantages, and novel features of the invention will become more apparent from the following detailed description when taken in conjunction with the accompanying drawings.

DETAILED DESCRIPTION OF THE PREFERRED EMBODIMENT

Three embodiments are provided in the following, and the example inflatable furniture assembly of the present invention is a sofa.

Figure 1:
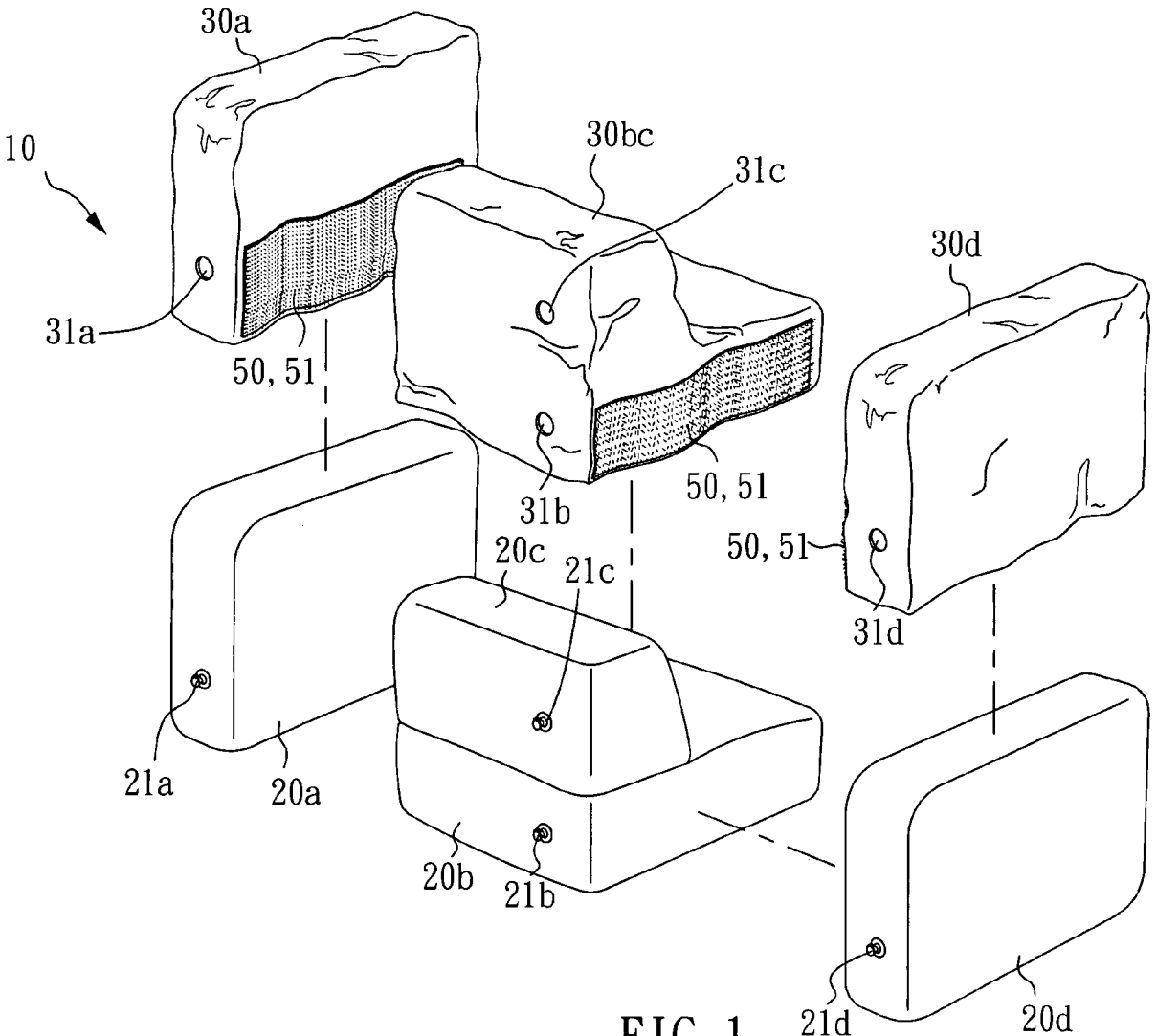
FIG. 1 is a perspective view of a first embodiment inflatable furniture assembly according to the present invention.

Please refer to FIG. 1 to FIG. 4, which disclose a first embodiment inflatable furniture assembly 10. As shown in FIG. 1, the inflatable furniture assembly 10 comprises a plurality of inflatable cushions 20*a*, 20*b*, 20*c*, 20*d*, and a plurality of covers 30*a*, 30*bc*, 30*d*. In this embodiment, the inflatable cushion 20*b* and the inflatable cushion 20*c* are originally two separate inflatable cushions, but they are combined together during the manufacturing process. The inflatable cushion 20*b* is a seat cushion of the inflatable furniture assembly 10, and the inflatable cushion 20*c* is a back cushion of the inflatable furniture assembly 10. When a user sits on the inflatable cushion 20*b*, the back of the user will push on the inflatable cushion 20*c*, and so the inflatable cushion 20*b* and the inflatable cushion 20*c* should be fixed strongly together (such as being glued together). Since the inflatable cushion 20*b* and the inflatable cushion 20*c* are combined together, the four inflatable cushions 20*a*, 20*b*, 20*c*, 20*d* only require three covers 30*a*, 30*bc*, 30*d* to cover the inflatable cushion 20*a*, the inflatable cushions 20*b*, 20*c* and the inflatable cushion 20*d* to form three units 40*a*, 40*bc*, 40*d*. The inflatable cushion 20*a*, the inflatable cushions 20*b*, 20*c* and the inflatable cushion 20*d* may be deflated when transported.

Figure 2:
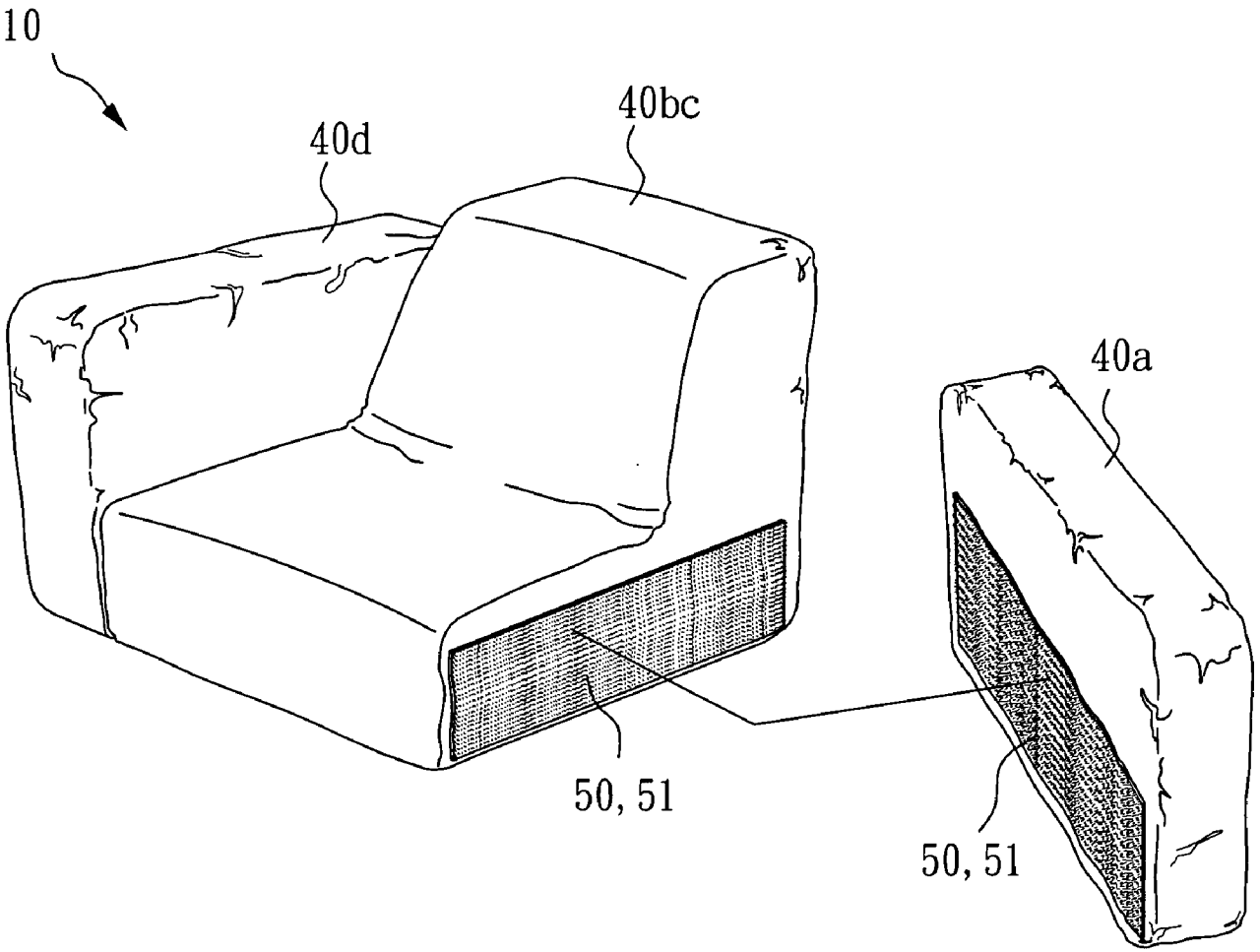
FIG. 2 is a schematic drawing of assembling the inflatable furniture assembly according to the present invention.
Figure 3:
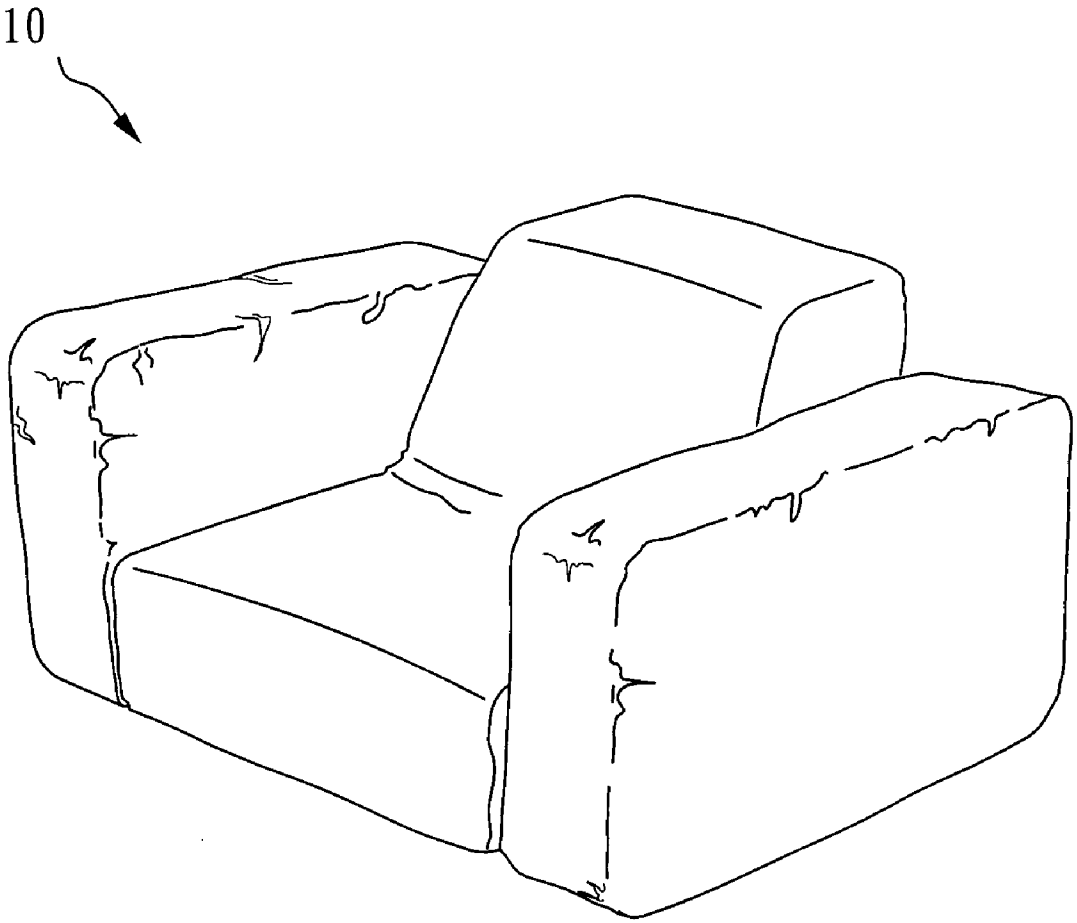
FIG. 3 is a front side view drawing of the inflatable furniture assembly according to the present invention.

As shown in FIG. 2 and FIG. 3, after three units 40*a*, 40*bc*, 40*d* are formed, connecting elements 50 of each unit 40*a*, 40*bc*, 40*d* can be combined together to form the inflatable assembly furniture 10. In this embodiment, the connecting elements 50 are self-adhesive tapes 51 (such as Velcro, where the two facing sides have a loop side and a hook side). However, the connecting elements 50 may also be other equivalent devices, such as laces or clips (not shown).

Figure 4:
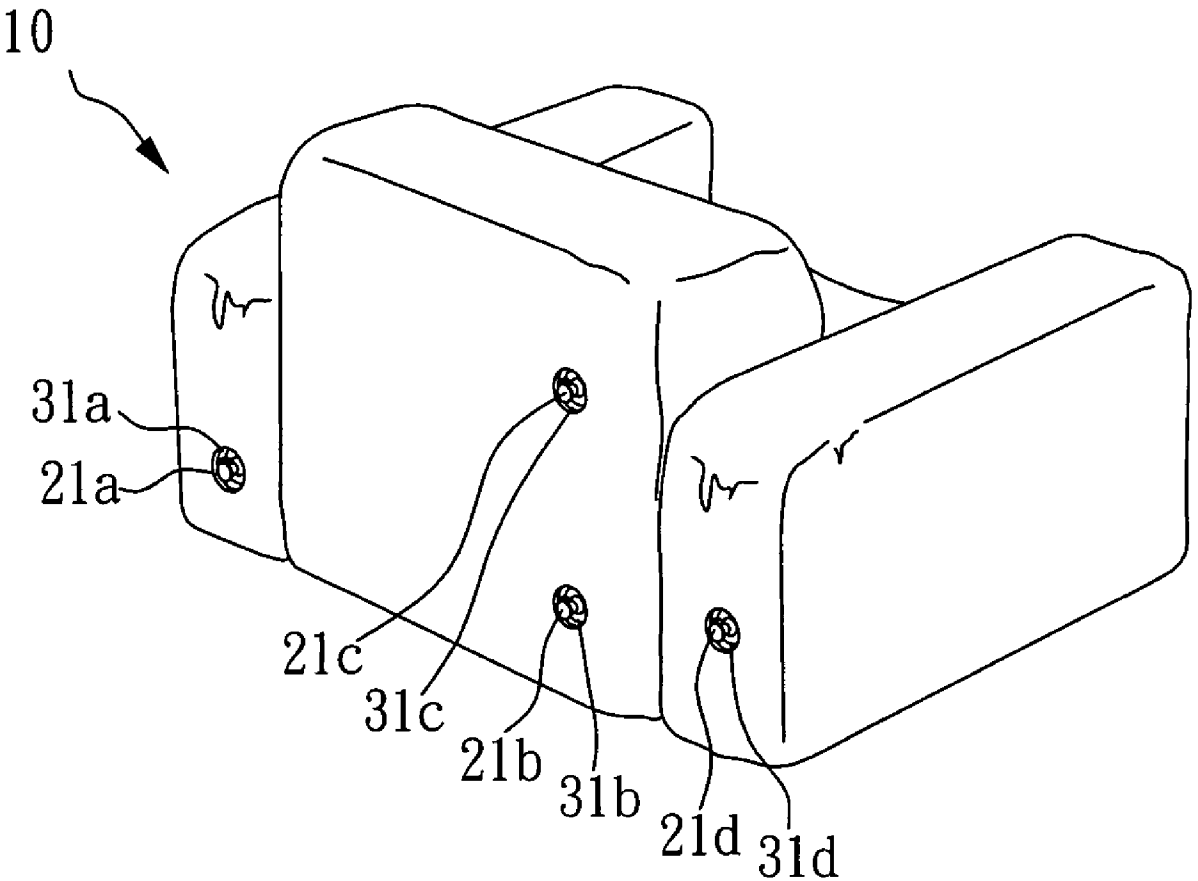
FIG. 4 is a rear side view drawing of the inflatable furniture assembly according to the present invention.

Before placing the three covers 30*a*, 30*bc*, 30*d* on the inflatable cushions 20*a*, 20*b*, 20*c*, 20*d*, each inflatable cushion 20*a*, 20*b*, 20*c*, 20*d* should be partially inflated, such as 80% inflated, to avoid difficulties when placing the covers on the inflatable cushions. In order to inflate the cushions, each inflatable cushion 20*a*, 20*b*, 20*c*, 20*d* has at least one inflation valve (which are marked as 21*a*, 21*b*, 21*c*, 21*d*). To inflate the inflatable cushions 20*a*, 20*b*, 20*c*, 20*d* after the covers 30*a*, 30*bc*, 30*d* have been put on, the covers 30*a*, 30*bc*, 30*d* may have openings 31*a*, 31*b*, 31*c*, 31 *d* corresponding to the inflation valves 21*a*, 21*b*, 21 *c*, 21*d*, as shown in FIG. 4. Also, when a user needs to store or move the inflatable furniture assembly 10, the assembly 10 can be deflated without taking off the covers 30*a*, 30*bc*, 30*d*.

The covers 30*a*, 30*bc*, 30*d* are an important characteristic of the present invention; because the inflatable cushions 20*a*, 20*b*, 20*c*, 20*d* are mostly made of plastic so the appearance and feeling of which is not appealing. However covers 30*a*, 30*bc*, 30*d* usually can be made of leather or cloth to improve the appearance of the inflatable furniture assembly 10.

Figure 5:
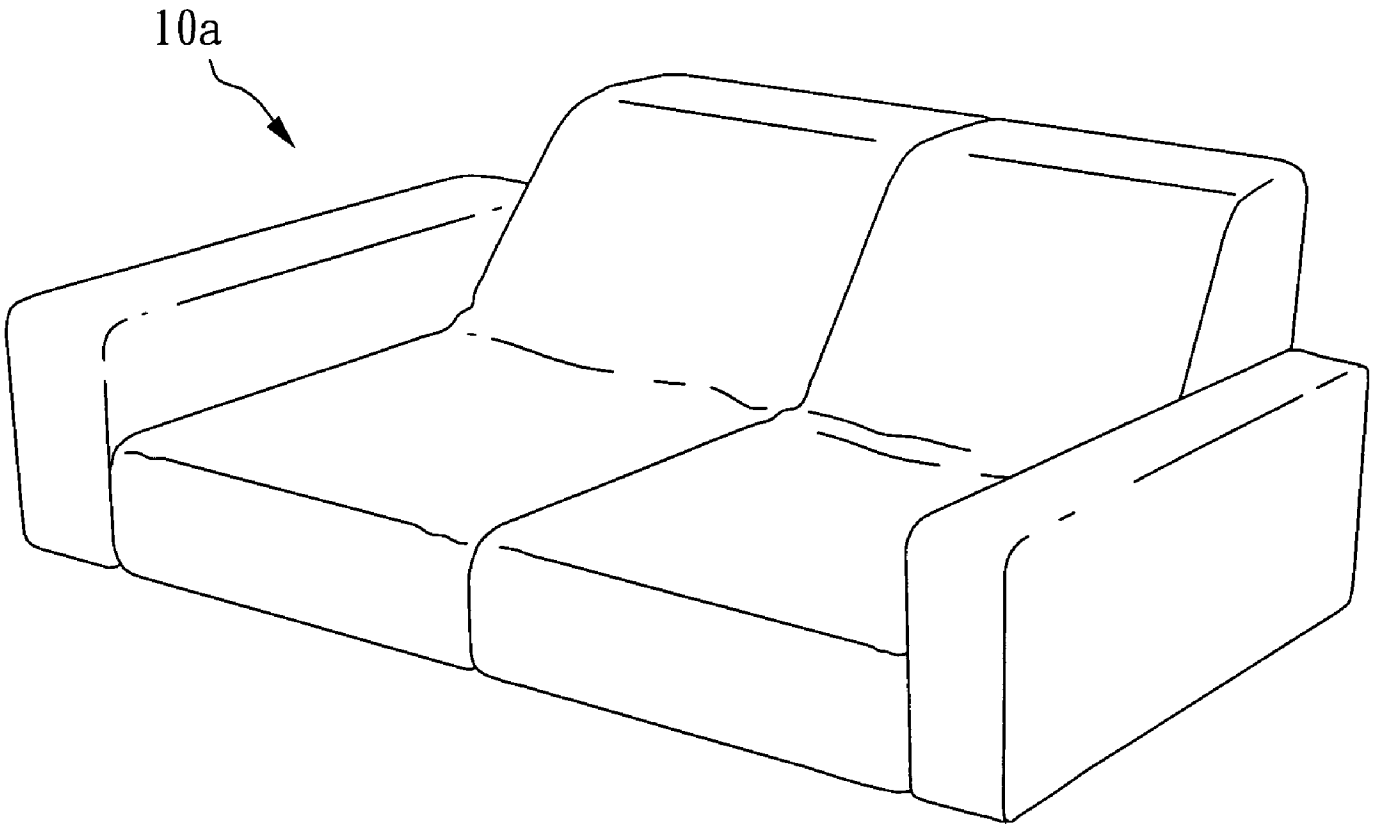
FIG. 5 is a perspective view of a second embodiment inflatable furniture assembly according to the present invention.

Please refer to FIG. 5 for a second embodiment of the present invention. A difference between the first embodiment and the second embodiment is that the cushions are combined to form an inflatable furniture assembly 10*a* for two, three, or four seats.

Figure 6:
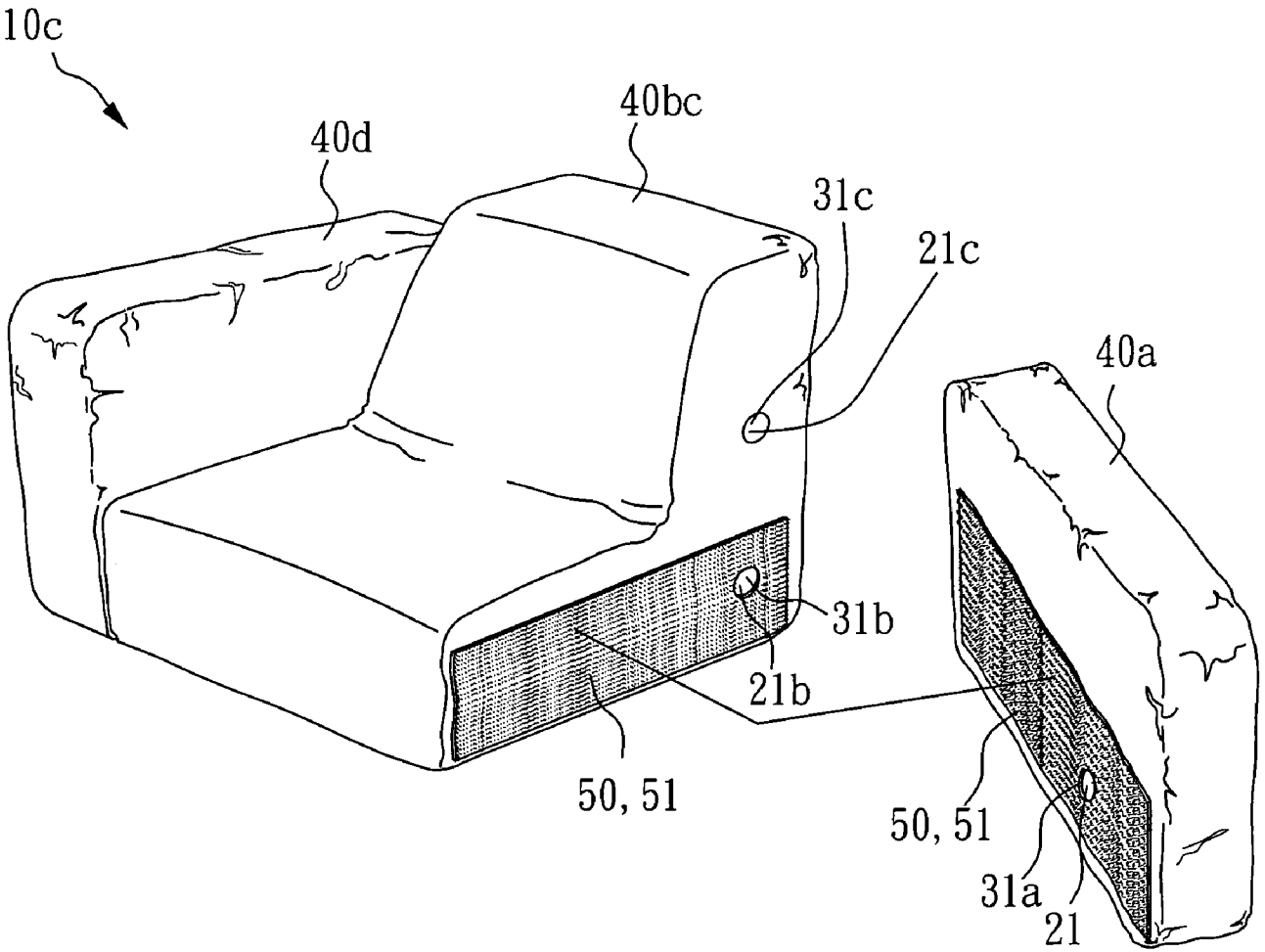
FIG. 6 is a perspective view of a third embodiment inflatable furniture assembly according to the present invention.

Please refer to FIG. 6 for a third embodiment of the present invention. A difference between the third embodiment and the second embodiment is that the inflation valves and the openings in the covers do not align with each other so that the inflation valves cannot be seen. For example, inflation valves 21*a*, 21*b*, 21*c* are positioned where the units 40*a*, 40*bc* are combined, and the covers 30*a*, 30*b*, 30*c* have corresponding holes 31*a*, 31*b*, 31*c*.

Figure 7:
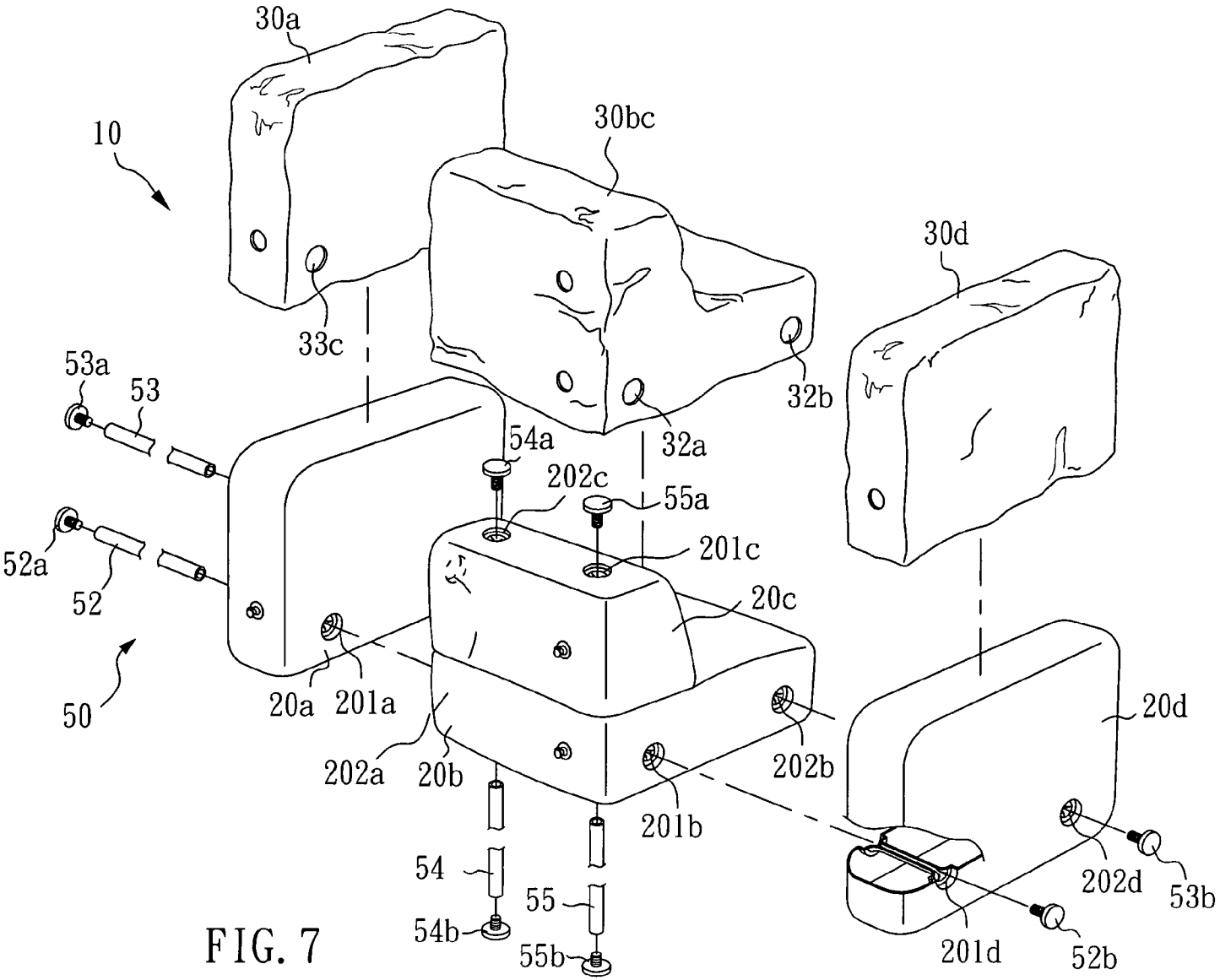
FIG. 7 is a perspective view of a fourth embodiment inflatable furniture assembly according to the present invention.
Figure 8:
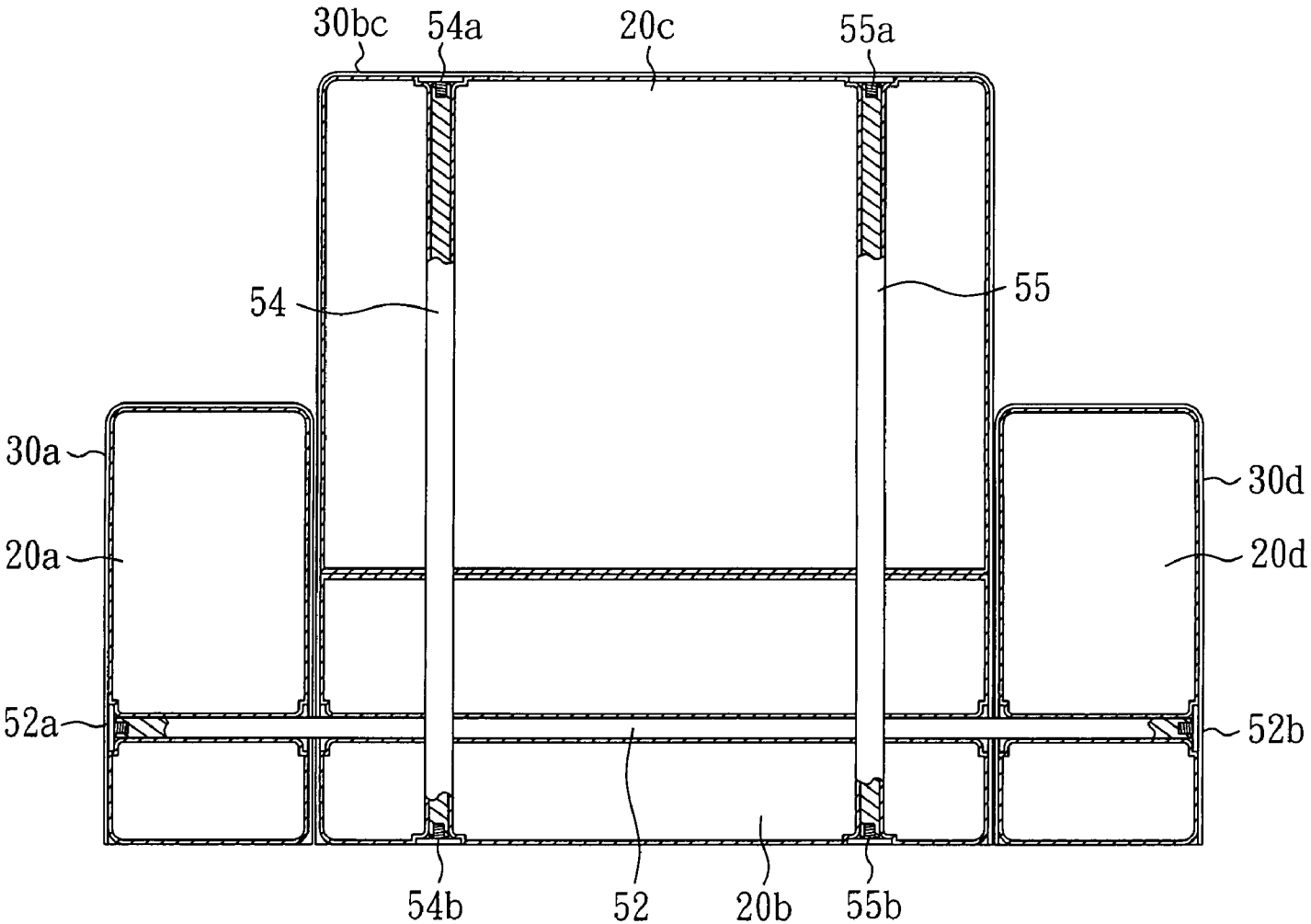
FIG. 8 is a cross-sectional view of the fourth embodiment inflatable furniture assembly according the present invention

Please refer to FIG. 7 and FIG. 8 for a fourth embodiment of the present invention. A difference between the fourth embodiment and the second embodiment is that the connecting elements 50 of the inflatable furniture assembly 10*c* comprise a plurality of connecting rods 52, 53, 54, 55, which are used to combine the inflatable cushions 20*a*, 20*b*, 20*c*, 20*d* together. The inflatable cushions 20*a*, 20*b*, 20*c*, 20*d* have through holes 201*a*, 202*a*, 201*b*, 202*b*, 201*c*, 202*c*, 201*d*, 202*d* through which the connecting rods 52, 53, 54, 55 pass, and the covers 30*a*, 30*bc*, 30*d* also have through holes 32*a*, 32*b*, 32*c* through which the connecting rods 52, 53, 54, 55 pass (not all through holes are shown in the drawing due to the viewing angle). The two ends of the connecting rods 52, 53, 54, 55 may be provided screw threads so that the two ends of the connecting rods 52, 53, 54, 55 can be fixed by fastening elements 52*a*, 52*b*, 53*a*, 53*b*, 54*a*, 54*b*, 55*a*, 55*b* (which are shown as nuts) after all inflatable cushions 20*a*, 20*b*, 20*c*, 20*d* have been combined together, thereby securing the combination. The fastening elements are not necessary, however, because after the inflatable cushions have been fully inflated, the through holes become constricted, and hence tighten around the connecting rods. The inflatable cushion 20*b* and the inflatable cushion 20*c* in the fourth embodiment can be manufactured separately.

Although the present invention has been explained in relation to its preferred embodiment, it is to be understood that many other possible modifications and variations can be made without departing from the spirit and scope of the invention as hereinafter claimed.

What is claimed is:

1. An inflatable furniture assembly comprising:

a plurality of inflatable cushions, wherein each inflatable cushion comprises an inflation valve;

at least two of the plurality of inflatable cushions each comprise a through hole passing through the each inflatable cushion;

a plurality of covers for covering the plurality of inflatable cushions to form a plurality of units; and a plurality of connecting elements for combining together the plurality of units, wherein the plurality of connecting elements comprise at least one connecting rod placed through the through holes of at least two of the plurality of inflatable cushions so that the at least two of the plurality of inflatable cushions are connected together by the at least one connecting rod; and the plurality of connecting elements further comprises a plurality of fixing elements placed at two ends of the at least one connecting rod.

2. The inflatable furniture assembly as claimed in claim 1 wherein the inflatable furniture assembly is an inflatable sofa assembly.

3. The inflatable furniture assembly as claimed in claim 1, wherein the number of covers is less than the number of inflatable cushions, and at least one unit comprises one cover and at least one inflatable cushion.

4. The inflatable furniture assembly as claimed in claim 1, wherein at least a portion of each cover comprises an opening positioned to correspond with the inflation valve so that each unit has at least one inflation valve.

* * * * *